United States Patent [19]

Masse

[11] 4,068,418

[45] Jan. 17, 1978

[54] COLLAPSIBLE SHELTER

[76] Inventor: Jean-Pierre Masse, 900 Tessier Street, Apt. 202, Sherbrooke, Quebec, Canada

[21] Appl. No.: 695,198

[22] Filed: June 11, 1976

[51] Int. Cl.[2] ..... E04B 1/34

[52] U.S. Cl. ..... 52/2

[58] Field of Search ..... 52/2; 428/36, 398; 285/150

[56] References Cited

U.S. PATENT DOCUMENTS

| | | | |
|---|---|---|---|
| 2,066,960 | 1/1937 | Cook et al. | 285/150 X |
| 2,297,150 | 9/1942 | Hunter | 52/2 |
| 3,172,166 | 3/1965 | Imbrecht | 52/2 |
| 3,258,883 | 7/1966 | Campanaro et al. | 52/2 |
| 3,364,632 | 1/1968 | Isaac | 52/2 |
| 3,599,677 | 8/1971 | O'Brien | 138/125 X |
| 3,899,853 | 8/1975 | Wertman | 52/2 |

FOREIGN PATENT DOCUMENTS

| | | | |
|---|---|---|---|
| 1,104,920 | 6/1955 | France | 52/2 |
| 473,916 | 3/1972 | Japan | 428/36 |
| 448,129 | 6/1936 | United Kingdom | 52/2 |

*Primary Examiner*—Alfred C. Perham

[57] ABSTRACT

An inflatable structural member and a structure employing such inflatable members. The structural members each comprise an inner, air-impermeable inflatable tube made from an inexpensive, extruded, thermoplastic material; and an outer flexible sheath restraining the inner tube when it is inflated. The sheath is also constructed to shape the tube to a desired curved shape.

5 Claims, 3 Drawing Figures

FIG. 6
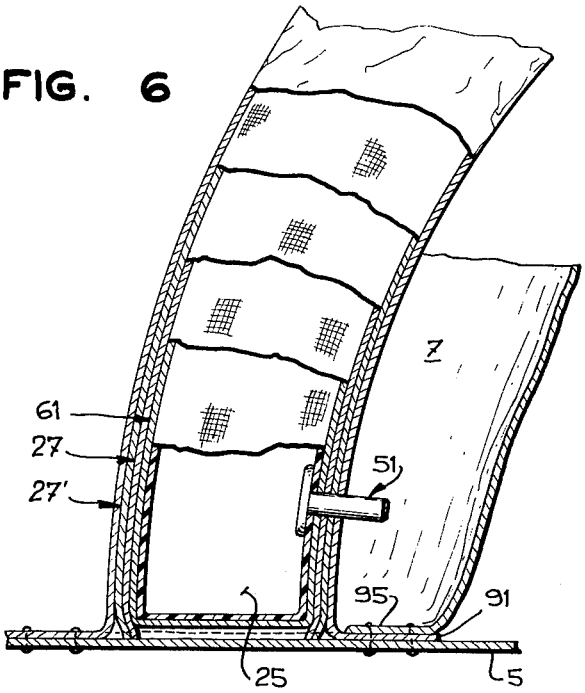
FIG. 7
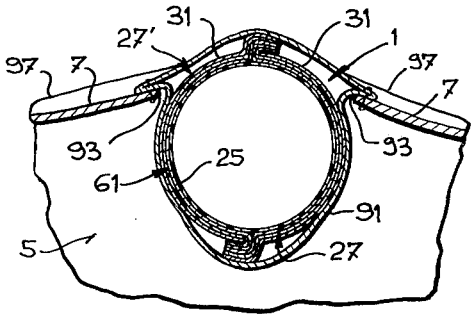
FIG. 9
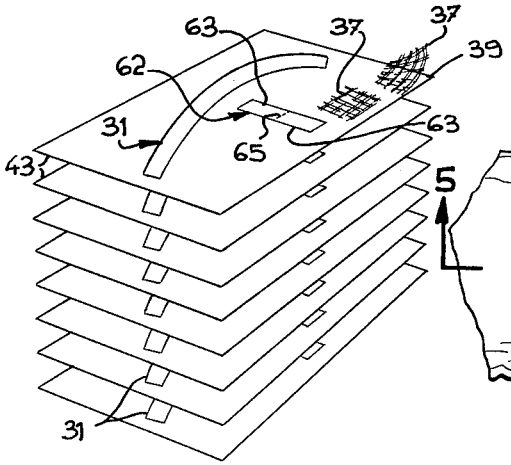
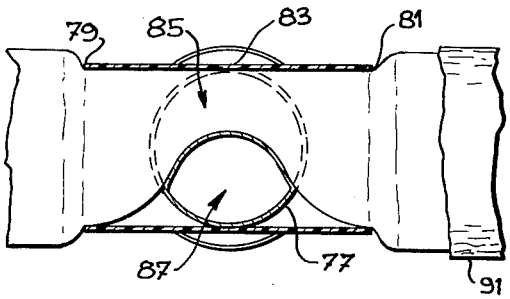
FIG. 5
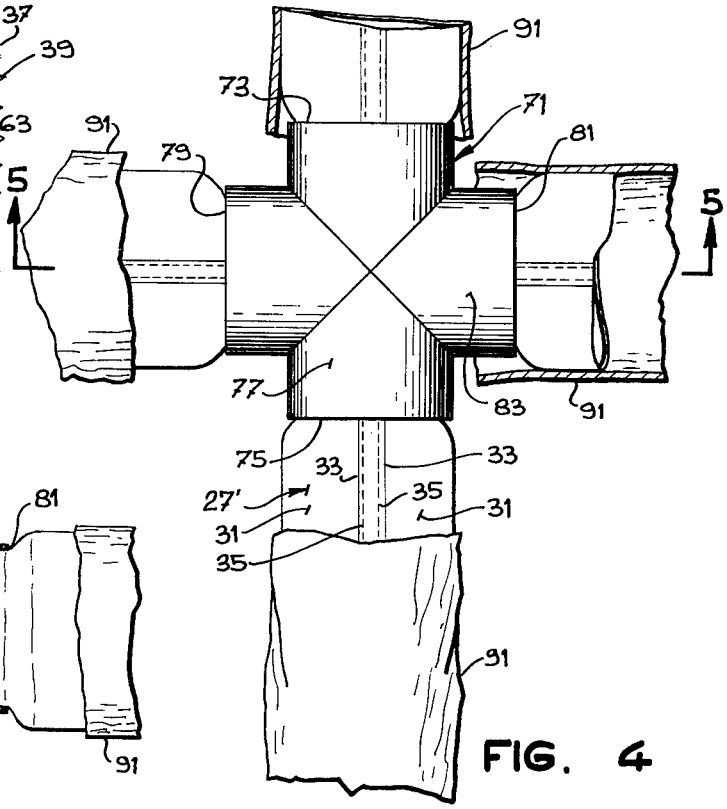
FIG. 4

COLLAPSIBLE SHELTER

This invention relates to a collapsible shelter using an inflatable armature structure having improved inflatable structural members.

Inflatable, structural members, and collapsible shelter structures employing such members, are known. Examples of such structures are shown in U.S. Pat. Nos. 547,119; 2,297,150 and 2,752,928 by way of example. The inflatable structural members are useful in structures that are to be temporarily erected, such as tents. The members reduce the weight of the structures, making it easy to transport them to the erection site. They can also reduce the storage space required by the structure when it is dismantled. In addition, the number of separate elements in the structure is reduced.

The construction of inflatable structural members however presents problems. The use of rubber for the inflatable tube in the structural members has become too expensive, making any structures employing rubber inflatable members, non-competitive with structures using rigid, non-inflatable structural members.

Thermoplastic film material is much cheaper than rubber. It has however been found difficult to construct a suitable inflatable tube from thermoplastic film. The film is cut, shaped into a tube and sealed at its overlapped edges. Such a tube is not air impermeable however since leakage occurs at the seal.

Inflatable tubes, extruded from relatively inexpensive thermoplastic material are air impermeable since they have no edge seals presenting leakage problems. However such tubes can readily fail, when repeatedly inflated, by exceeding their elastic limit, ballooning out and finally rupturing.

It has been found that the extruded tubes can be prevented from failing by covering them with a protective flexible and non-expandible sheath which prevents the tubes from exceeding their elastic limit. The sheaths preferably are made out of an open weave fabric material which can be strengthened with a thermoplastic film lamination.

Where inflatable tubes are to be used in curved structural members, as in tent construction for example, the curved tubes tend to straighten, and/or twist in their sheaths thus making it difficult, if not impossible, to achieve the desired structural shape. To minimize this twisting, and to obtain a curved shape, it has been proposed to construct a specially reinforced tube and to use tapes affixed to the tube to shape it. (See U.S. Pat. No. 2,297,150) Such construction is obviously expensive.

I have found that the above disadvantages can be largely avoided by resort to my collapsible shelter which has a flexible wall structure and an inflatable tubular armature structure, the latter being made of a plurality of structural rib members having, when inflated, a predetermined curvature. According to my invention, each such structural member comprises an inner air-impermeable inflatable elastic tube and means, at the ends thereof, for closing the said tube; at least one outer non-expandible flexible sheath containing the inner tube snugly when the latter is inflated into the said predetermined curvature whereby to restrain its outward expansion and prevent it from rupturing. According to my invention, the sheath is formed from a pair of elongated strips of like sizes pre-cut according to the said predetermined curvature whereby to provide uniform stress distribution in the sheath when the inner tube is inflated, means being provided to join the strips along the longitudinal edges thereof to form the sheath.

According to a preferred embodiment, both strips are preferably cut from woven material so as to have the same bias at any point along their length whereby to minimize twisting of the structural strip member while still following the desired curvature.

The present invention thus provides an inflatable structural member that is inexpensive and simple in construction, lightweight, yet strong.

The present invention further provides an inflatable structural member that takes and maintains a desired curved shape when inflated, with a minimum of twisting.

Yet, the present invention provides a structure with the improved inflated structural members which structure can be easily erected or collapsed, which is lightweight but strong, which is easily transportable and readily storable in a minimum of space, and which employs a minimum of separate elements.

The present invention still provides a structure with inflatable structural members which members are connected together at the top of the structure in a specific manner.

An embodiment of the invention will now be described in detail having reference to the accompanying drawings in which:

FIG. 4 is a plan, detail view showing the structural frame members at the top of the tent;

FIG. 5 is a cross-section view taken along line 5—5 of FIG. 4;

FIG. 6 is a longitudinal cross-section view of a structural frame member at its bottom end;

FIG. 7 is a transverse cross-section view of the structural frame member near its bottom end;

FIG. 9 is a perspective view showing how parts of the structural frame member are cut.

Figure 1:
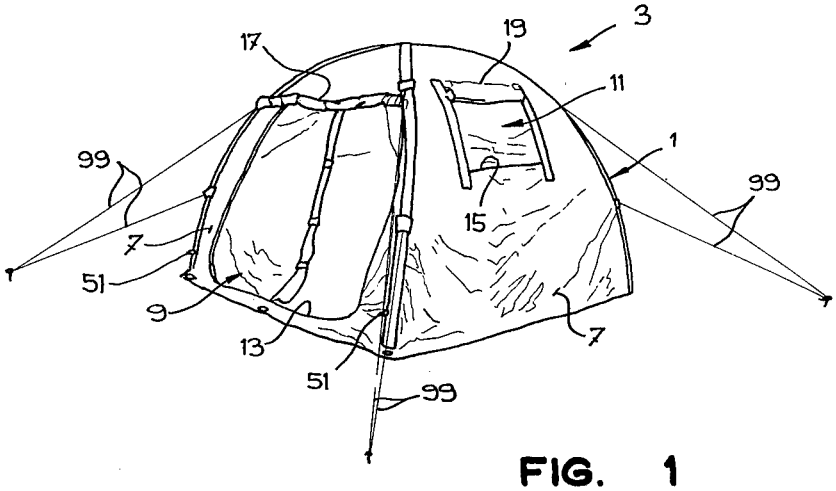
FIG. 1 is a perspective view of a tent constructed in accordance with the principle of the present invention.
Figure 2:
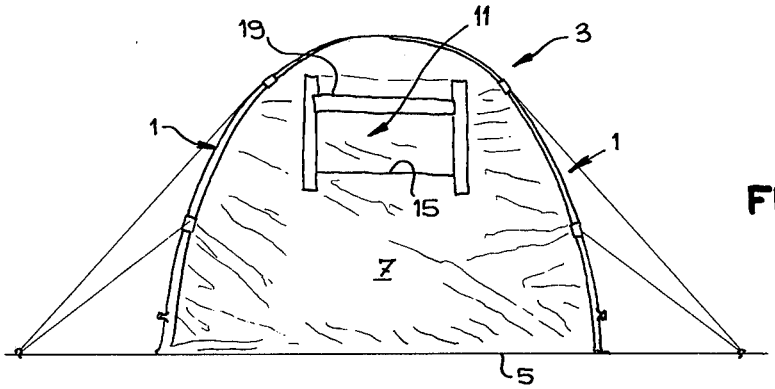
FIG. 2 is an elevation view of the tent.
Figure 3:
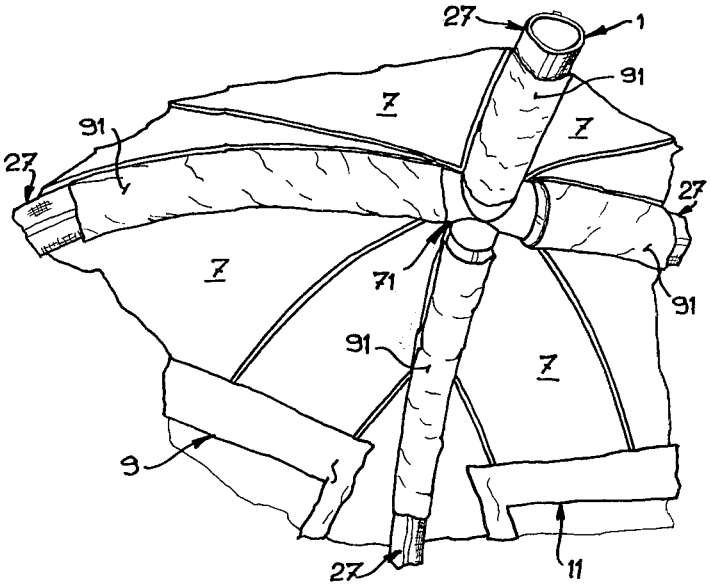
FIG. 3 is an inside perspective view of the top of the tent.

The type of inflatable structural members 1 of the shown embodiment, made according to the present invention, can be used in many shelter structures, such as for example, temporary booths, temporary garages, etc.. In the present embodiment however, the inflatable structural members 1 are used in a tent 3, as shown in FIGS. 1 to 3.

The tent 3 employs four inflatable structural frame members 1 located at its corners. The tent 3 is generally square at the base and upwardly rounded with a square floor 5 and a somewhat parabolic wall skin 7. A door 9 is provided in one wall 7 and a window 11 is provided in another wall 7. The door 9 and window 11 each comprise an opening 13, 15 respectively in walls 7. The openings 13, 15 are closed with panels 17, 19 respectively which can be rolled up as shown in FIGS. 1 and 2 to open the door and window, or unrolled to close them.

The floor 5 and wall skin 7 are made from suitable known fabric material, such as canvas for example, and are cut in the desired shape. The floor 5 and walls 7 are joined to each other and to the inflatable structural members 1 by sewing or other suitable means as will be described.

Figure 8:
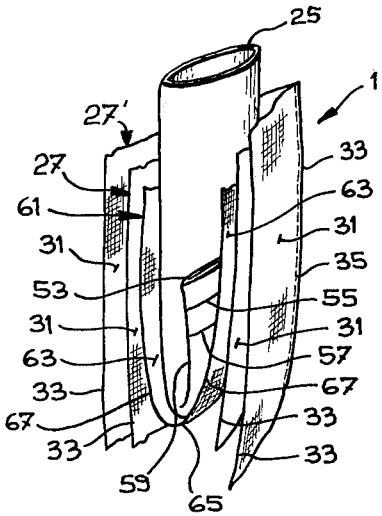
FIG. 8 is a perspective view showing details of the construction of the bottom of the structural frame member.

Each inflatable structural frame member 1, as shown in FIGS. 6, 7 and 8 comprises an inner, air impermeable, inflatable elastic tube 25 and a covering shown to be made of two coaxial flexible tubular sheaths 27, 27' over one another and over the inner tube 25 for restraining it. The inner tubes 25 are made from flexible, elastic polyvinylchloride material extruded into the desired size. They are relatively inexpensive while providing the required air impermeable, inflatable qualities. A preferred elastic PVC material is KVB 67 manufactured by BF Goodrich.

Each outer tubular sheath 27, 27' is made from two flat pieces 31 of relatively strong flexible non-expandible material, identical in shape and each cut to the axial shape it is desired to have the member 1 assume when it is inflated. In the tent 3 shown, the desired shape is parabolic. As shown in FIG. 9, each piece 31 is cut to a parabolic shape. Two pieces 31 for each sheath are joined together along their edges 33 by stitching 35 to form the sheaths 27, 27'. To provide the necessary strength to restrain the inner tube 25, the sheaths 27, 27' are made from woven material which can be reinforced if desired. A suitable woven material is Triflex (Trademark), manufactured by Consolidated Bathhurst Ltd. and consits of strips of an open or loose weave of polyethylene threads 37, embedded in a film 39 of thermoplastic material. Other strong material strips, woven in an open weave, can be used.

Each piece 31 of woven material, as previously stated, is cut to the shape it is desired to have the structural member take when tube 25 is inflated. When the structural member is to be curved each of the two pieces of woven material making up the sheath are not only cut to the same desired shape but also cut on the same bias. Then, when the pieces 31 are joined together and have the same bias along their length, twisting of the structural member is minimized when the tube is inflated.

When making a substantially symmetrical structure like the tent 3, having four corner posts 1 radiating out and down from a central top location, the eight pieces 31 forming the four sheaths 27 on all four posts are cut simultaneously from eight stacked layers 43 (FIG. 9) of woven material to ensure the same shape and bias. With all four corner sheaths cut on the same bias, including both inner and outer sheaths 27, 27', twisting of the tent, when the tubes are inflated, is still further minimized.

It is also important to size the sheaths 27, 27' so that they fit snugly about the tubes 25. When the inner tube 25 is inflated, its outer diameter should substantially equal the inner diameter of the adjacent sheath 27. If a second outer sheath 27' is used, over the first sheath 27, its inner diameter should substantially equal the outer diameter of the first sheath 27. Should the sheath 27 adjacent the inner tube 25 be larger than the tube 25, the latter could indeed balloon beyond its elastic limit and fail. On the other hand, if the inner tube 25 is larger than the sheath when inflated, it twists the member and can burst the sheath along its stitching.

Each structural member 1 is provided with an air valve 51 (FIG. 6) so that it can be inflated. The valve 51 is suitably mounted in the inner tube 25 and extends through the sheaths 27, 27'. It is desirable that the valve 51 be suitable for low pressure since the members are inflated to a relatively low pressure of 14 to 16 PSI. A suitable valve is manufactured by R.K. Roberts Corp. of N.J., Ser. No. 830 ADL.

Each inner tube 25, near its lower end 53, is closed by a double line of sealing 55, 57 such as heat sealing, as shown in FIG. 8. The sealed lower end portion 59 of the tube 25 is then folded back on the remainder of the tube and this end is then placed in a sleeve 61. The latter is formed by cutting one symmetrical piece 62 of material, as shown in FIG. 9, with both arms 63, 63 of the piece having the same bias. The piece 62 is folded over along a central fold line 65 and the edges 67 of arms 63 are sewn together to form the sleeve 61. The bottom end of the tube 25 rests against the fold 65. The sleeve 61 reinforces the bottom end closure of the tube.

The top end of each inflatable structural member, can be closed in the same manner as the bottom end, employing a sleeve similar to sleeve 61. Preferably however, the tops of opposing members can be joined together by a hollow connecting member. Each two members then only require one inflating valve. In the tent illustrated, where four corner posts join together at the top, a single fitting 71 (FIGS. 3 and 4) is used to structurally join the four posts 1 together at one top central point. The fitting is also designed to pneumatically join opposing members together in pairs. As shown in FIGS. 4 and 5, the fitting 71 has a cross shape with one pair of opposing ends 73, 75 being those of a first hollow tube 77 and the other pair of opposing ends 79, 81 being those of a second hollow tube 83 passing transversely through the first tube 77. The second tube 83 has a bridge which reduces its cross-sectional area 85 where it passes through the first tube 77 thus reducing the cross-sectional area 87 of the first tube 77 where it passes. The inner inflatable tubes 25 are fixed by any suitable sealing means to the ends of the fitting 71.

Each inflatable structural member 1, forming a corner post of the tent 3, has a loose flexible sleeve 91 covering it (FIG. 7). The side edges 93 of the wall skin 7 are stitched or otherwise suitably attached to folds of the outer sleeve 91. The lower end of the sleeve 91 is attached to the side edge 97 of the floor 5 of the tent by sewing or other suitable means. Also attached to the tower end 91 is the lower edge 95 of a strip of fabric material spacedly surrounding the corner post and fixed, along the side edges, to the wall 7 to define a pocket capable of holding sundry articles.

When the corner posts 1 are inflated through the valves 51, they assume the parabolic shape as dictated by the shape of the sheaths 27, 27' thus raising the attached walls 7 and, in effect, erecting the tent as shown in FIGS. 1 or 2. Anchoring lines 99 can be attached from the corner posts 1 to the ground to anchor the erected tent.

Deflating the corner posts 1 through valves 51 collapses the tent 3 and it can be readily stored in a small space.

I claim:

1. A collapsible shelter having a flexible outer wall structure and an inflatable tubular armature structure fixed to said wall structure and capable, when inflated, of causing erection of said wall structure as well as collapse thereof when deflated, said armature structure being made of a plurality of structural rib members having, when inflated, a predetermined curvature, each of said structural members comprising:

an inner air-impermeable inflatable elastic tube and means, at the ends thereof, for closing said tube;

at least one outer non-expandible flexible sheath containing said inner tube snugly when the latter is inflated into said predetermined curvature, whereby to restrain its outward expansion and prevent it from rupturing, wherein said sheath is formed from a pair of elongated strips of like sizes precut according to said predetermined curvature whereby to provide uniform stress concentration in said sheath when said inner tube is inflated, and means joining said strips along the longitudinal edges thereof to form said sheath.

2. A collapsible shelter as claimed in claim 1, wherein a short portion at the ends of said inner tubes is bent back and said closing means comprise: seal lines extending transversely of said inner tube ends and wherein bag-like sleeves are provided into which said bent back portions are inserted and retained.

3. A collapsible shelter as claimed in claim 2, wherein said armature structure comprises two structural rib members and means, at the top of said flexible wall structure, for structurally connecting said two structural rib members together, said connecting means comprising: a rigid fitting formed as an integral body comprising a pair of tubes of which one extends through the other and forms a bridge therein defining an upper and a lower passage, and wherein one of said tubular rib members passes through one of said passages and the other rib member passes through the other passage.

4. A collapsible shelter as claimed in claim 1 wherein the two sheath strips are cut from woven material so as to have the same bias at any point along their length whereby to minimize twisting of the structural rib members when the latter are inflated.

5. A collapsible shelter as claimed in claim 4, wherein said woven material comprises strips of thermoplastic material woven into an open weave and laminated into a thermoplastic film.

* * * * *